US008584802B2

(12) United States Patent
Earl et al.

(10) Patent No.: US 8,584,802 B2
(45) Date of Patent: Nov. 19, 2013

(54) MOBILE ELEVATING WORK PLATFORM

(75) Inventors: Joseph Earl, Grande Prairie (CA); Thomas Samuel, Calgary (CA)

(73) Assignee: Rigless Rentals Inc, Grand Prairie (CA)

( * ) Notice: Subject to any disclaimer, the term of this patent is extended or adjusted under 35 U.S.C. 154(b) by 309 days.

(21) Appl. No.: 12/975,138

(22) Filed: Dec. 21, 2010

(65) Prior Publication Data

US 2011/0253476 A1 Oct. 20, 2011

(30) Foreign Application Priority Data

Apr. 15, 2010 (CA) ..... 2699556

(51) Int. Cl.
*E06C 5/04* (2006.01)

(52) U.S. Cl.
USPC ..... 182/127; 182/64.1; 182/69.6

(58) Field of Classification Search
USPC ..... 182/127, 63.1, 64.1, 69.6
See application file for complete search history.

(56) References Cited

U.S. PATENT DOCUMENTS

| | | | | |
|---|---|---|---|---|
| 2,241,275 | A * | 5/1941 | Edward Shinn et al. | 187/243 |
| 3,473,627 | A | 10/1969 | Repka | |
| 3,882,964 | A | 5/1975 | Schellenberg | |
| 3,937,301 | A | 2/1976 | Bertail | |
| 4,290,495 | A | 9/1981 | Elliston | |
| 4,390,080 | A * | 6/1983 | Bushnell, Jr. | 182/115 |
| 4,440,262 | A * | 4/1984 | Hunt et al. | 182/114 |
| 4,442,919 | A | 4/1984 | Fulcher | |
| 5,295,555 | A | 3/1994 | Strange | |
| 6,347,684 | B1 | 2/2002 | Fath | |
| 6,523,641 | B2 | 2/2003 | Smith | |
| 7,469,749 | B2 | 12/2008 | Folk | |

FOREIGN PATENT DOCUMENTS

CA 2 701 102 A1 5/2009

OTHER PUBLICATIONS

"The Colter W.A.S.P.," © 2009 Colter Energy Services Inc., <http://www.colterenergy.com> [retrived Mar. 29, 2011], at least as early as Dec. 21, 2010, 2 pages.
"Oilfield Hauling & Equipment Rental," Lamb's Trucking Ltd., <http://www.lambstrucking.com> [retrived Mar. 29, 2011], at least as early as May 13, 2010, 1 page.
"HD Work Platform," HD Energry Rentals, <http://www.hdenergyrentals.com/workplatform.htm> [retrived Jun. 14, 2011], at least as early as Aug. 13, 2010, 9 pages.

* cited by examiner

*Primary Examiner* — James O Hansen
*Assistant Examiner* — Kristine Florio
(74) *Attorney, Agent, or Firm* — Christensen O'Connor Johnson Kindness PLLC

(57) ABSTRACT

There is provided a mobile height-adjustable platform that includes a chassis with ground engaging wheels. A mast is pivotally connected to the chassis and is movable between a transport position where the mast is parallel to and disposed over the chassis, and an operative position where the mast is perpendicular to the chassis and extends upwards. A conveyor moves along the mast and a work platform is pivotally connected to the conveyer. The work platform is movable between a transport position where the platform is parallel to the mast and an operating position where the platform is perpendicular to the mast.

5 Claims, 5 Drawing Sheets

MOBILE ELEVATING WORK PLATFORM

FIELD

This relates to a mobile elevating work platform.

BACKGROUND

U.S. Pat. No. 4,290,495 (Elliston) entitled "Portable workover rig with extendable mast substructure, platform mounted drawworks and adjustable wellhead anchor" describes a transportable mast that is used for workovers. A height-adjustable platform is also available from Colter Energy Services Inc. of Calgary, AB (www.colterenergy.com).

SUMMARY

There is provided a mobile height-adjustable platform that includes a chassis with ground engaging wheels. A mast is pivotally connected toward an outer perimeter of the chassis and is movable between a transport position where the mast is parallel to and disposed over the chassis, and an operative position where the mast is perpendicular to the chassis and extends upwards. A conveyor moves along the mast and a work platform is pivotally connected to the conveyer. The work platform is movable between a transport position where the platform is parallel to the mast and an operating position where the platform is perpendicular to the mast and extends outwards from the outer perimeter of the chassis. In the transport position, an upper surface of the work platform may be adjacent to the mast. the mast may be pivotally connected to a rear edge of the chassis.

According to another aspect, there may be a safety railing along at least opposed sides of the work platform, the safety railing being separated by a width that is greater than a width of the mast, the mast nesting within the safety railing in the transport position. There may be collapsible railing sections attached to the work platform or the safety railing.

According to another aspect, there may be a height-adjustable ladder or a height-adjustable staircase having a first end connected to the work platform and a second end adjacent to the chassis.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
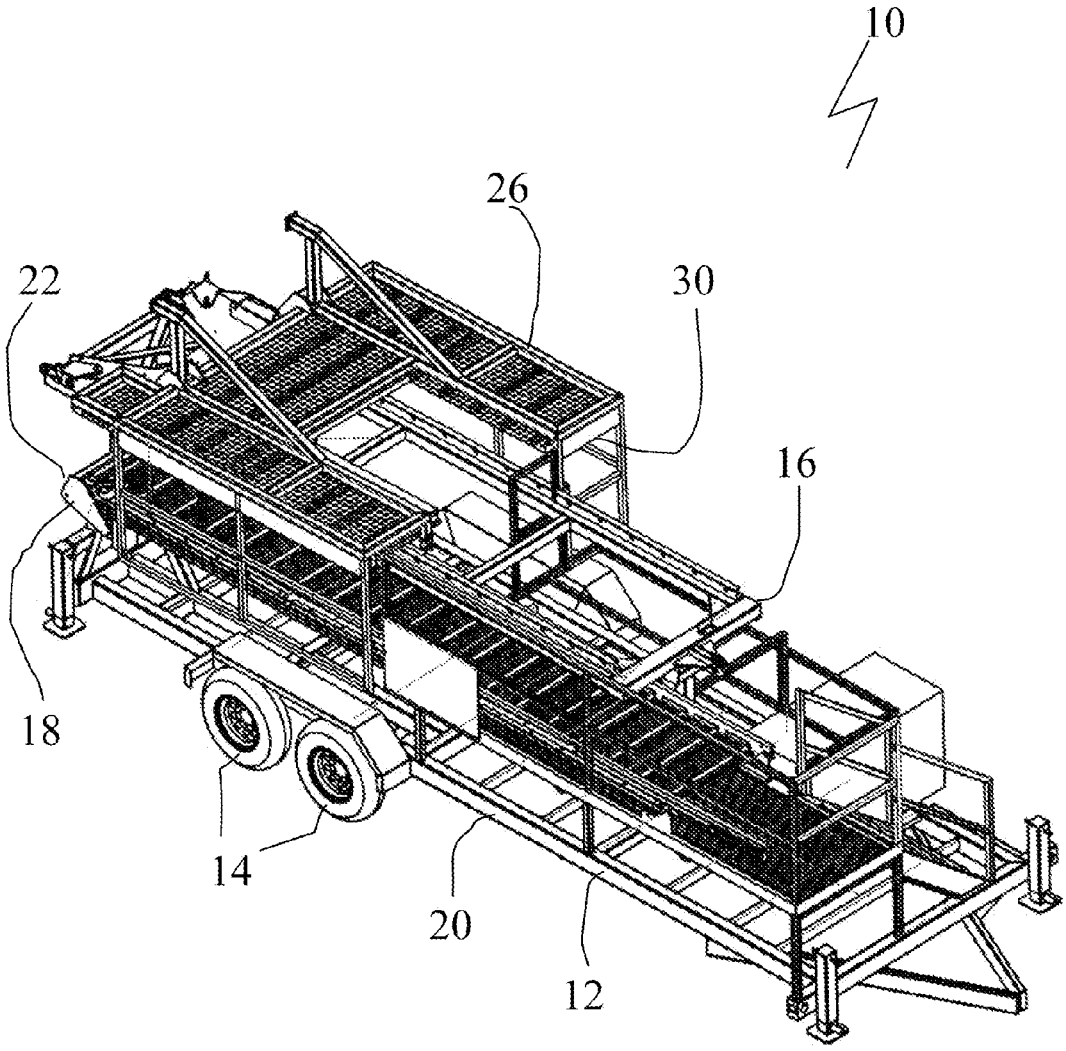
FIG. 1 is a perspective view of a mobile elevating work platform in the transport position.

A mobile elevating work platform generally identified by reference numeral 10, will now be described with reference to FIGS. 1 through 6.

Figure 2:
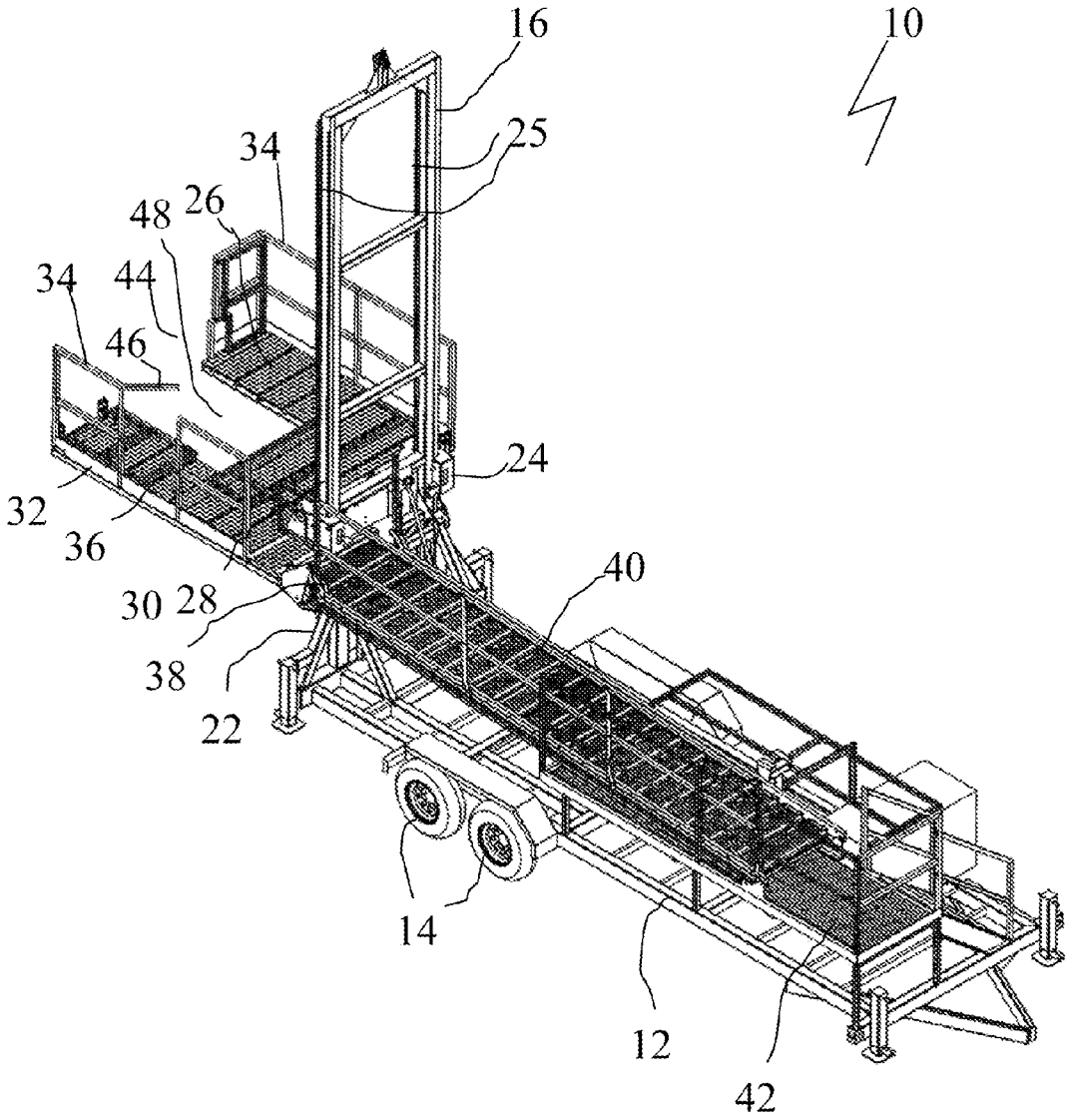
FIG. 2 is a perspective view of the mobile elevating work platform shown in FIG. 1 in the operative position.
Figure 5:
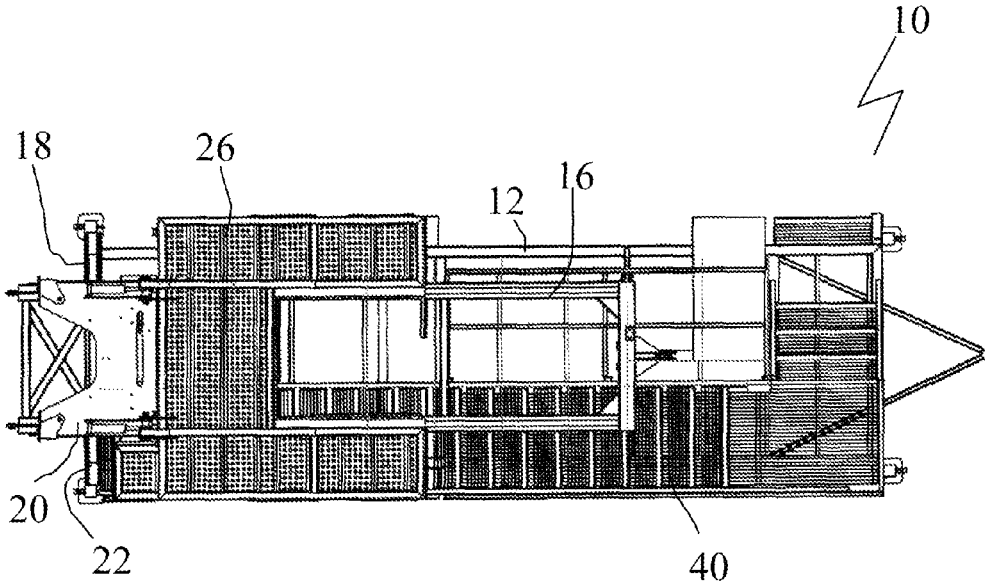
FIG. 5 is a top plan view of the mobile elevating work platform in the transport position.

Structure and Relationship of Parts:

Referring to FIG. 1, a mobile height-adjustable platform 10 includes a chassis 12 having ground engaging wheels 14. As shown, chassis 12 is a trailer that is designed to be pulled behind a truck (not shown). Referring to FIG. 5, a mast 16 is pivotally connected at a pivot point 18 at the rear edge 22 of chassis 12 and is movable between a transport position and an operating position. Rear edge 22 is preferred as allows mast 16 to be folded along the length of chassis 12, and can be more easily backed into place. Referring to FIG. 1, in the transport position, mast 16 is parallel to and disposed over chassis 12. Referring to FIG. 2, in the operating position, mast 16 is perpendicular to chassis 12 and extends upward. A conveyor 24 moves along the mast 16 to move a work platform 26. As shown, mast 16 has parallel tracks 25 that conveyor 24 engages and moves along. Conveyor 24 is designed to engage mast 16 in a manner that provides stability under expected loading conditions and during height adjustment. Conveyor 24 may be self-driven, such that it moves itself along tracks 25, or, more preferably, it may be externally controlled, such as by a winch (not shown) or other means.

Figure 6:
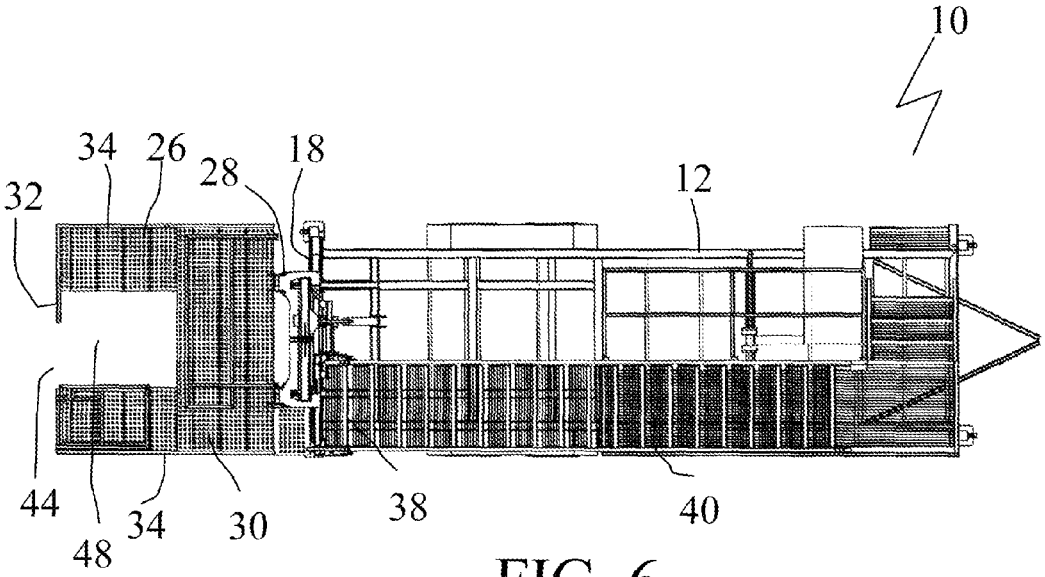
FIG. 6 is a top plan view of the mobile elevating work platform in the operative position.

Work platform 26 is connected to conveyor 24 by a pivotal connection 28. Referring to FIG. 6, pivotal connection 28 also moves work platform 26 between a transport position and an operating position. Referring to FIG. 1, in the transport position, work platform 26 is parallel to mast 16 such that the upper surface 30 of work platform 26 is adjacent to mast 16, or in other words, work platform 26 is inverted. Referring to FIG. 2, in the operating position, work platform 26 is perpendicular to mast 16 and extends outward from outer perimeter 20 of chassis 12. As shown, a first end 38 of a height-adjustable staircase 40 is connected to work platform 26 and a second end 42 of staircase 40 is adjacent to chassis 12. As platform 26 is raised, staircase 40 raises along with it to provide easy access. The staircase 40 is designed such that, as one end is raised, the individual stairs remain horizontal. While staircase 40 is preferred for platform access and safety reasons, it will be understood that, instead of staircase 40, it could also be a ladder, etc.

Referring to FIG. 2, there are safety railings 32 along the side 34 of work platform 26 that are separated by a width that is greater than the width of mast 16 to allow mast 16 to nest within railings 32 in the transport position, as shown in FIG. 1. Referring to FIG. 2, collapsible railing sections 36 may be attached to work platform 26 or safety railings 32 to allow the necessary amount of separation. Referring to FIG. 2, railings 32 have openings 44 in front and may have an opening 46 on the side to provide greater accessibility and functionality. Work platform 26 also has an opening 48 on the floor to allow platform 26 to be positioned over and around a wellhead (not shown).

Figure 3:
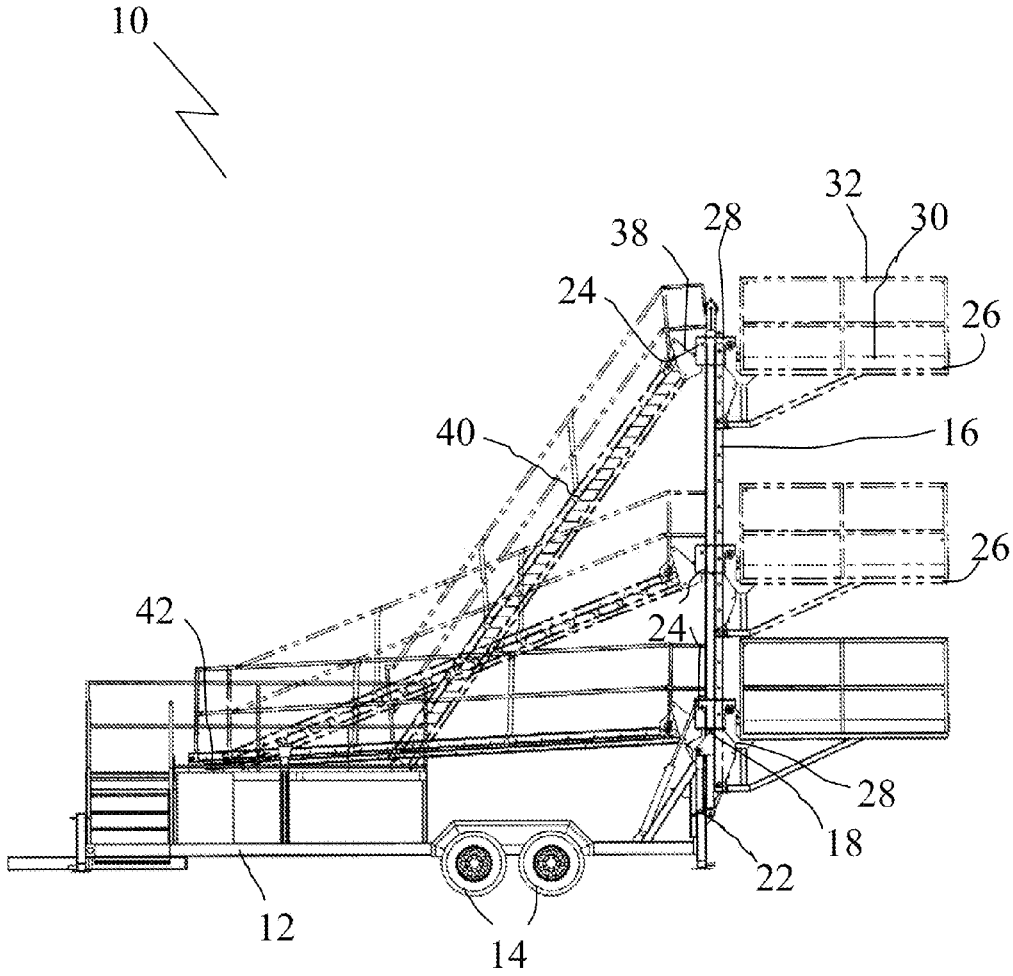
FIG. 3 is a side elevation view of the mobile elevating work platform shown in FIG. 2 with the work platform at different heights.
Figure 4:
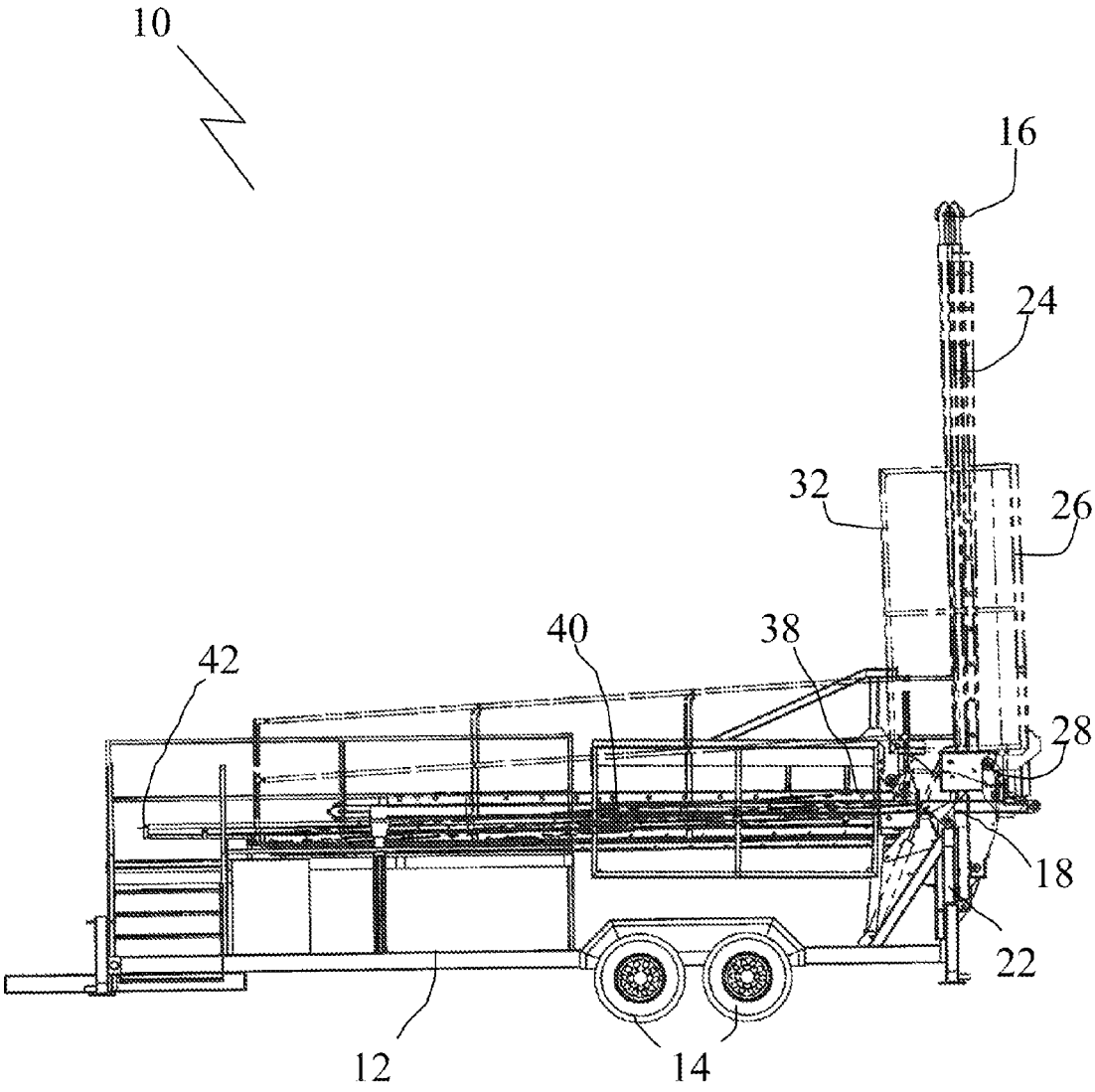
FIG. 4 is a side elevation view of the mobile elevating work platform shown in FIG. 2 with the work platform in the transport position.

Operation:

Referring to FIG. 1, mobile height-adjustable platform 10 is in the transport position. Mast 16 is parallel to and disposed over chassis 12 and work platform 26 is parallel to mast 16. Referring to FIG. 4, mast 16 is pivotally rotated about pivot connection 18 to the operating position such that it is perpendicular to chassis 12 and extends upwards away from chassis 12. Referring to FIGS. 2 and 3, once mast 16 is raised, work platform 26 is pivoted from the transport position into the operative position by pivoting work platform 26 about pivot connection 28. Platform 26 is then perpendicular to and extends outwards from mast 16. Platform 26 will generally be in the lower position shown in FIG. 3 at this point, and will be positioned with floor opening positioned over the wellhead (not shown). Once raised, railing 32 is prepared for use by installing collapsible railing sections 36 to provide a safe working environment. Conveyor 24 can then be used to move work platform 26 up and down the length of mast 16. Referring to FIG. 3, a height-adjustable staircase 40 allows access to work platform 26 from chassis 12.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A mobile height-adjustable platform, comprising:

a chassis having ground engaging wheels;

a mast pivotally connected toward an outer perimeter of the chassis, the mast having a transport position parallel to and disposed over the chassis and an operating position perpendicular to the chassis and extending upward;

a conveyor that moves along the mast;

a work platform connected to the conveyor by a pivotal connection, the pivotal connection moving the platform between a transport position parallel to the mast and an operating position perpendicular to the mast and extending outward from the outer perimeter of the chassis; and a height adjustable staircase having a first end connected to move with the conveyor along the mast and a second end movably mounted adjacent to the chassis, the second end moving toward the mast as the conveyor is raised and moving away from the mast as the conveyor is lowered such that the height adjustable staircase is underlying the mast when the mast is in the transport position.

2. The mobile height-adjustable platform of claim 1, wherein, in the transport position, an upper surface of the work platform is adjacent to the mast.

3. The mobile height-adjustable platform of claim 2, further comprising a safety railing along at least opposed sides of the work platform, the safety railing being separated by a width that is greater than a width of the mast, and the mast nesting within the safety railing in the transport position.

4. The mobile height-adjustable platform of claim 3, further comprising collapsible railing sections attached to the work platform or the safety railing.

5. The mobile height-adjustable platform of claim 1, wherein the mast is pivotally connected to a rear edge of the chassis.

* * * * *